US007108359B2

(12) United States Patent
Shimosato et al.

(10) Patent No.: US 7,108,359 B2
(45) Date of Patent: Sep. 19, 2006

(54) INK JET PRINTER HEAD AND METHOD FOR FABRICATING THE SAME

(75) Inventors: Masashi Shimosato, Tagata-gun (JP); Shinji Koizumi, Mishima (JP); Takashi Kikuchi, Numazu (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 522 days.

(21) Appl. No.: 10/120,486

(22) Filed: Apr. 12, 2002

(65) Prior Publication Data

US 2002/0109757 A1 Aug. 15, 2002

Related U.S. Application Data

(62) Division of application No. 09/500,909, filed on Feb. 9, 2000, now Pat. No. 6,415,507.

(30) Foreign Application Priority Data

Feb. 9, 1999 (JP) ..... 11-30989
Dec. 14, 1999 (JP) ..... 11-353982

(51) Int. Cl.
*B41J 2/045* (2006.01)
*H04R 17/00* (2006.01)

(52) U.S. Cl. ..... 347/68; 347/69; 29/25.35

(58) Field of Classification Search ..... 347/20, 347/67–72; 310/311, 331, 333; 29/25.35, 29/890.1

See application file for complete search history.

(56) References Cited

U.S. PATENT DOCUMENTS 4,550,325 A * 10/1985 Viola ..... 347/68
5,345,256 A * 9/1994 Stortz ..... 347/20
5,471,231 A * 11/1995 Hiraishi et al. ..... 347/68
5,619,235 A * 4/1997 Suzuki ..... 347/69
5,757,404 A * 5/1998 Witteveen et al. ..... 347/71

FOREIGN PATENT DOCUMENTS

JP 7-101056 4/1995
JP 10-315471 * 2/1998
JP 10-315471 12/1998

* cited by examiner

*Primary Examiner*—Stephen Meier
*Assistant Examiner*—Geoffrey S. Mruk
(74) *Attorney, Agent, or Firm*—Oblon, Spivak, McClelland, Maier & Neustadt, P.C.

(57) ABSTRACT

A plurality of ink jet printer heads can be obtained from a single substrate through the following steps: a piezoelectric body forming step of cutting a piezoelectric member into a desired width to form a piezoelectirc body, a fitting recess forming step of forming a recess for fitting therein of the piezoelectric body in a base member, a substrate forming step of embedding the piezoelectric body into the recess to form a substrate, a grooving step of forming a plurality of desired grooves in parallel in the substrate, a head substrate forming step of forming an electrically conductive film on inner walls of the grooves to form a head substrate, an electroconductive pattern forming step of making connection to the electrically conductive film for the application of voltage thereto, a top plate joining step of joining a top plate to the head substrate to form a head substrate-top plate composite, a head forming step of cutting the head substrate-top plate composite at a desired position to form a head, and a nozzle plate joining step of joining a nozzle plate to a cut side having groove openings of the head.

2 Claims, 15 Drawing Sheets

INK JET PRINTER HEAD AND METHOD FOR FABRICATING THE SAME

BACKGROUND OF THE INVENTION

1. Field of the Invention

The present invention relates to an ink jet printer head to be used, for example, in a printer, a copying machine, or a facsimile device, as well as a method for fabricating the same. Particularly, the invention is concerned with an ink jet printer head capable of being obtained from a single substrate, as well as a method for fabricating the same.

2. Description of the Prior Art

Heretofore, various types of ink jet printer heads utilizing a shear mode of a piezoelectric material have been proposed, including the one disclosed in Japanese Unexamined Patent Publication No. Sho 63-247051. In many of them, however, as pointed out in Japanese Unexamined Patent Publication No. Hei 7-101056, fine grooves serving as pressure chambers are formed by means of a diamond blade and the piezoelectric material typified by PZT (lead zirco-titanate) is ferroelectric. For these reasons, even a portion not concerned in ink jet have a large capacitance, thus giving rise to the problem that the energy efficiency is poor.

In the method disclosed in the aforesaid Japanese Unexamined Patent Publication No. Hei 7-101056, as shown in FIG. 1, a piezoelectric member 2 and a low dielectric member 3 are joined together on a base member. Further, a top plate 4 and a nozzle plate 5 are joined together, and a large number of grooves are formed to form an ink chamber 6. The portion of each ink chamber 6 located in the piezoelectric member 2 is a portion, a, concerned with use in an ink jet, while the portion thereof located in the low dielectric member 3 is a portion, b, not concerned in ink jet. With this configuration, the capacitance of the portion, b, not taking part in operation of an ink jet in the ink chamber 6 is made low to increase the energy efficiency.

Problems involved in such conventional techniques will now be described. In Japanese Unexamined Patent Publication No. Hei 7-101056 there is disclosed nothing disclosed about means for obtaining a large number of ink jet printer heads from a single substrate and thus the technique disclosed therein is poor in mass-productivity.

Nor is there found therein any concrete disclosure about how to bond constituent members. Since electrodes are formed within grooves, if air bubbles or the like are formed in adhesive layers, the electrodes may be short-circuited with adjacent elements, or conversely the electrodes may not be connected well on the adhesive layers, which is apt to cause an accident of open circuit.

Further, in such a structure as disclosed in the foregoing Japanese Unexamined Patent Publication No. Hei 7-101056, wherein the piezoelectric member 2 which is movable and the low dielectric member 3 which is not movable are joined together, an adhesive is present in the boundary between the piezoelectric member 2 using a ceramic material or the like and the low dielectric member 3 using an alumina substrate or the like, but as known well, ceramic materials and resins are markedly different in mechanical characteristics such as Young's modulus, so if variations occur in the thickness of the adhesive, there occur variations in the deformation of the piezoelectric member 2. If the thickness of the adhesive is large, the adhesive serves as a damper and will not obstruct the deformation of the piezoelectric member 2 so greatly, but if it is too small, one end of the piezoelectric member 2 assumes a solid state and obstructs the deformation of the piezoelectric member.

SUMMARY OF THE INVENTION

It is an object of the present invention to permit a plurality of ink jet printer heads to be obtained from a single substrate and thereby improve mass-productivity.

It is another object of the present invention to prevent formation of air bubbles in adhesive layers and thereby prevent, upon formation of electrodes within grooves, short-circuit of the electrodes with adjacent elements and prevent the occurrence of an open-circuit accident caused by unsatisfactory connection of the electrodes on the adhesive layers.

It is a further object of the present invention to prevent the occurrence of variations in the deformation of piezoelectric members and thereby improve the print quality.

It is a still further object of the present invention to improve the energy efficiency.

It is a still further object of the present invention to easily form electrodes of a required film thickness within fine grooves.

According to the present invention, in one aspect thereof, there is provided an ink jet printer head fabricating method comprising the steps of joining pre-polarized piezoelectric members so that respective poles are opposed to each other, cutting the thus-joined piezoelectric members into a desired width to form a piezoelectric body, forming a recess for fitting therein of the piezoelectric body in a base member formed of a material different from the material of the piezoelectric members, embedding the piezoelectric body into the recess to form a substrate, forming a plurality of desired grooves in parallel in the piezoelectric body-embedded side of the substrate to form a grooved substrate, forming an electrically conductive film on inner walls of at least the grooves including two such piezoelectric members in the grooved substrate to form a head substrate, making connection to the electrically conductive film for the application of voltage thereto, joining a top plate to the head substrate to form a head substrate-top plate composite, cutting the head substrate-top plate composite at a desired position to form a head, and joining a nozzle plate to a cut side having groove openings of the head.

According to the present invention, in another aspect thereof, there is provided an ink jet printer head fabricating method comprising the steps of cutting two pre-polarized piezoelectric members into a desired width to form a piezoelectric body, forming a recess for fitting therein of the piezoelectric body in a base member formed of a material different from the material of the piezoelectric members, embedding the piezoelectric body into the recess to form a substrate, forming a plurality of desired grooves in parallel in the piezoelectric body-embedded side of the substrate to form a grooved substrate, forming an electrically conductive film on inner walls of at least the grooves in the grooved substrate to form a head substrate, making connection to the electrically conductive film for the application of voltage thereto, joining a top plate to the head substrate to form a head substrate-top plate composite, cutting the head substrate-top plate composite at a desired position to form a head, and joining a nozzle plate to a cut side having groove openings of the head.

According to the present invention, in a further aspect thereof, there is provided an ink jet printer head comprising a head substrate formed by the steps of cutting a pre-polarized piezoelectric member into a desired width to form a piezoelectric body, embedding the piezoelectric body into a recess of a base member formed of a material different from the material of the piezoelectric member to form a substrate, forming a plurality of desired grooves in the piezoelectric body-embedded side of the substrate, and forming an electrically conductive film on inner walls of the grooves; a top plate joined to one side of the head substrate; and a nozzle plate joined to an open side of the grooves, the nozzle plate having ink jet orifices formed respectively for the grooves.

According to the present invention, in a still further aspect thereof, there is provided an ink jet printer head comprising a head substrate formed by the steps of cutting two piezoelectric members into a desired width to form a piezoelectric body, the two piezoelectric members having been joined together so that respective poles are opposed to each other, embedding the piezoelectric body into a recess of a base member formed of a material different from the material of the piezoelectric members to form a substrate, forming a plurality of desired grooves in the piezoelectric body-embedded side of the substrate, and forming an electrically conductive film on inner walls of the grooves including the two piezoelectric members; a top plate joined to one side of the head substrate; and a nozzle plate joined to an open side of the grooves, the nozzle plate having ink jet orifices formed respectively for the grooves.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
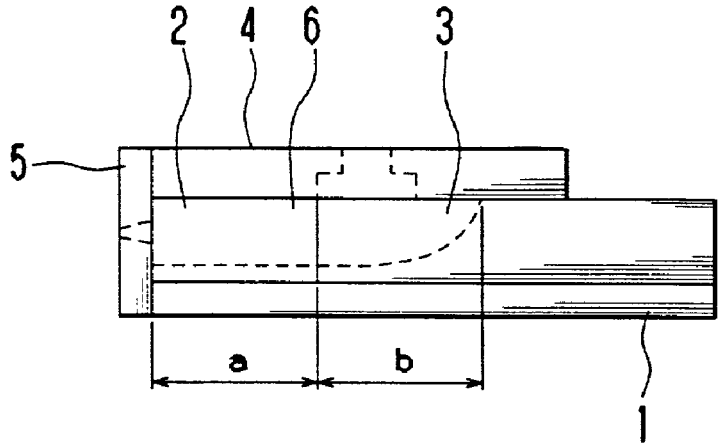
FIG. 1 is a side view showing a conventional example of an ink jet printer head.
Figure 2:
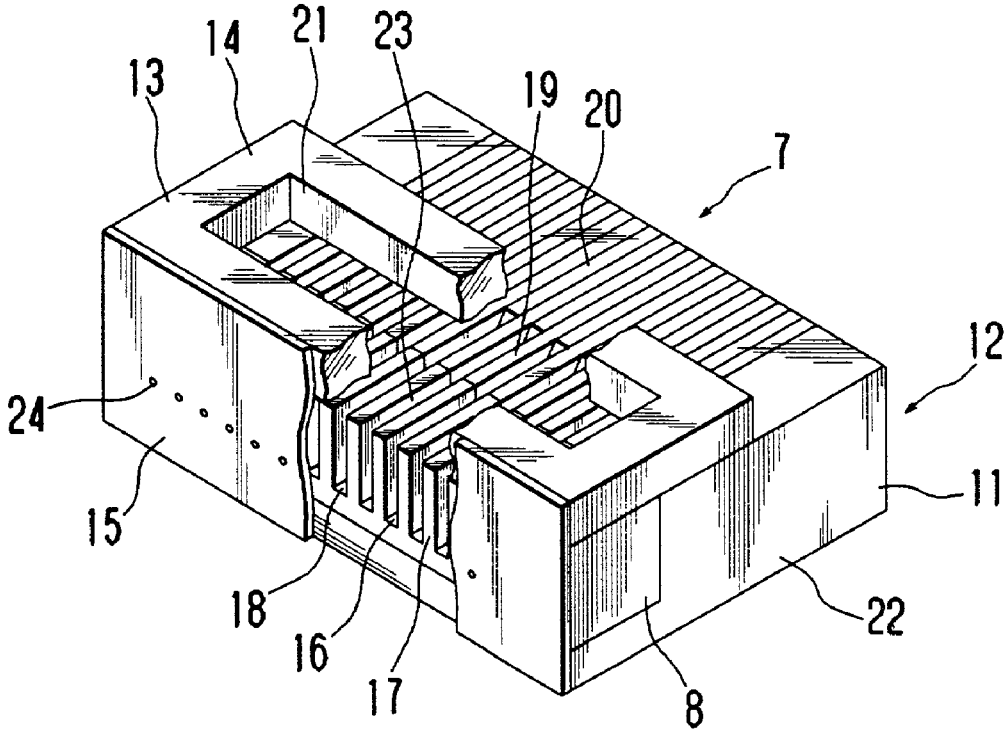
FIG. 2 is a partially cut-away perspective view of an ink jet printer head according to the first embodiment of the present invention.

The first embodiment of the present invention will now be described with reference to FIGS. 2 to 11. As shown in FIG. 2, an ink jet printer head 7 embodying the present invention has such a structure as shown in FIG. 2. According to the illustrated structure, a piezoelectric member 8 using a piezoelectric material such as PZT (lead zirco-titanate) is cut into predetermined shape and size to form a piezoelectric body 25, the piezoelectric body 25 is combined with a base member 11 formed using a material smaller in dielectric constant than the piezoelectric member 8 to constitute a laminate substrate 12, the laminate substrate 12 and a top plate 13 are bonded or joined together to form a substrate-top plate composite 14, and a nozzle plate 15 having a thickness of about 10 to 100 μm is integrally bonded to the substrate-top plate composite 14.

The piezoelectric member 8 formed of PZT is polarized in the plate thickness direction. The laminate substrate 12 with the piezoelectric member 8 incorporated therein is formed with a large number of grooves 16 extending from an upper surface of the piezoelectric member 8 and reaching the interior of the same member, the grooves 16 being open on a front side and closed on a rear side. The grooves 16 are formed in parallel by grinding with, for example, a diamond wheel of a dicing saw which is used for cutting an IC wafer or the like. Support walls 17 each present between adjacent grooves 16 serve as drive portions of pressure generating means 18 and their shape is equal to the shape of the grooves 16. The size of each groove 16 differs, depending on the specification of the ink jet printer head 7, but, for example, it is 0.2 to 1 mm deep, 20 to 200 μm wide, and 1 to 20 mm long.

Figure 3A:
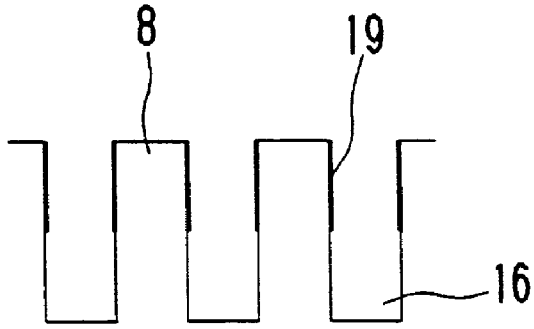
FIG. 3(A) is a front view showing in what state an electrode is formed by a single piezoelectric member having a thickness equal to the depth of a groove.
Figure 3B:
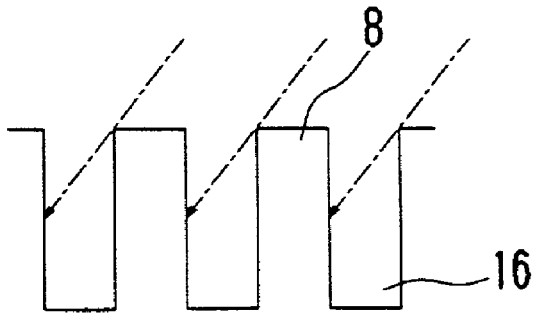
FIG. 3(B) is a front view showing an electrode forming method which uses a vacuum deposition method.

As shown in FIG. 3(A), on an inner surface of each groove 16 is formed an electrode 19 up to about half of a side face of each support wall 17 by depositing a metal such as nickel or aluminum thereon in accordance with a vacuum deposition method for example. In this case, a lower end position of each electrode 19 can be set by performing vacuum deposition obliquely from above the laminate substrate 12 (base member 11) so that the scatter of particles to be deposited is restricted by an end portion of an upper surface of the support wall 17, as shown in FIG. 3(B).

When the electrodes 19 are formed by a vacuum deposition method for example, they are extended from the rear portion of the grooves 16 up to an upper surface of the base member 11. The thus-extended portions of the electrodes are then subjected to photoetching to form wiring patterns 20.

Figure 3C:
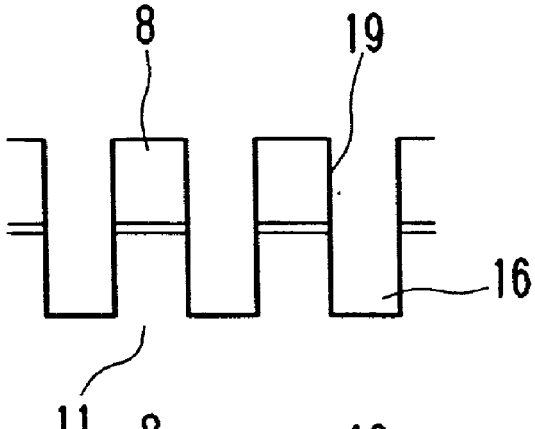
FIG. 3(C) is a front view showing a state in which an electrode is formed throughout the whole of each side face of a groove by a single piezoelectric member having a thickness which is half of the groove depth.
Figure 3D:
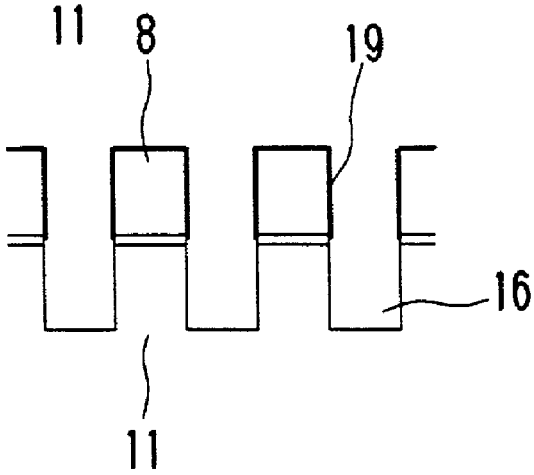
FIG. 3(D) is a front view showing a state in which an electrode is formed for approximately half of-each side face of a groove by a single piezoelectric member having a thickness which is half of the groove depth.

Grooves 16 may be formed in such a manner as shown in FIGS. 3(C) and 3(D). As shown in those figures, grooves 16 are formed through the whole of a piezoelectric member 8 and at a depth corresponding to the thickness of the piezoelectric member 8 and reaching a base member 11, and electrodes 19 are formed within the grooves 16. By so doing there can be obtained a shear mode type ink jet printer head 7 wherein the thickness of the piezoelectric member 8 is about half of the depth of each groove 16. In this case, the electrodes 19 may each be formed throughout the whole of a side face of each groove 16, as shown in FIG. 3(C), or may be formed for only about half of each groove 16, as shown in FIG. 3(D). In the example shown in FIGS. 3(C) and 3(D), since approximately a lower half of each support wall 17 is integral with the base member 11, the absence of an adhesive layer causes no variations although the effect of suppressing the obstruction to the movement of the piezoelectric member 8 attained by the presence of an adhesive layer decreases.

In the top plate 13 is formed such a hollow portion as shown in FIG. 2, which hollow portion serves as an ink reservoir 21 communicating with rear ends of the grooves 16 in the laminate substrate 12. The top plate 13 is bonded to the laminate substrate 12 with an adhesive or the like to form a substrate-top plate composite 22, and a nozzle plate 15 is bonded integrally to a front side of the substrate-top plate composite 22 with use of an adhesive. The grooves 16 thus closed their front and upper sides with the nozzle plate 15 and the top plate 13 are used as pressure chambers 23 which also serve as ink flow paths. Ink is fed to the pressure chambers 23 through in ink reservoir 21. As to the ink reservoir 21, a cover plate having an opening which permits introduction of ink from the exterior may be bonded to the ink reservoir, or there may be used a plate of a shape which covers the ink reservoir. Since a rear portion of an upper surface of the laminate substrate 12 is exposed behind the top plate 13, a drive circuit can be connected through an FPC or the like to the wiring patterns 20 which are positioned in the rear portion.

In the ink jet printer head 7 constructed as above, with ink fed into the pressure chambers 23, the support walls 17 as drive portions positioned on both sides of each pressure chamber 23 to be driven are bent away from each other gradually by a shear mode deformation of the piezoelectric member 8 which is polarized in the plate thickness direction and are then restored rapidly to their initial positions to pressurize the ink present within the pressure chambers 23, thereby causing an ink droplet to be jetted from an associated ink jet orifice 2–4 formed in the nozzle plate 15. In this case, for the prevention of crosstalk, the support walls 17 of the pressure generating means 18 are driven so that even-number pressure chambers 23 and odd-number pressure chambers 23 are pressurized in an alternate manner. In the ink jet printer head 7, since the ink jet orifices 24 are formed so that their rear portions are expanded and front portions tapered, the ink pressurized in each pressure chamber 23 can be jetted efficiently.

Figure 4:
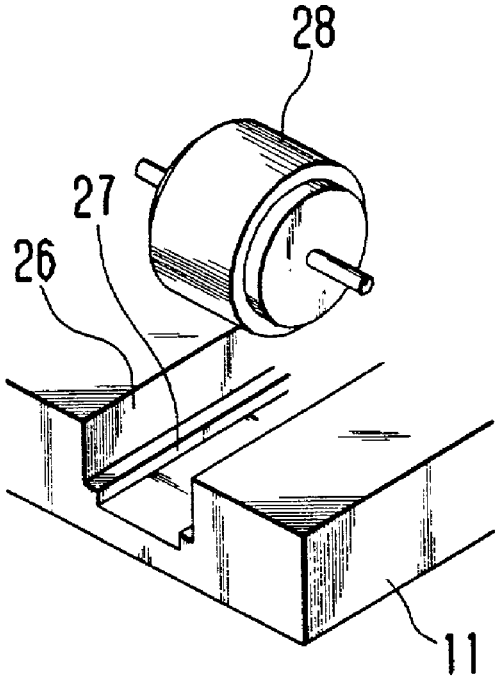
FIG. 4(A) is a perspective view showing a groove forming step.
FIG. 4(B) is a perspective view showing a head substrate forming step in which a piezoelectric body is joined and fixed to a base member.
Figure 4:
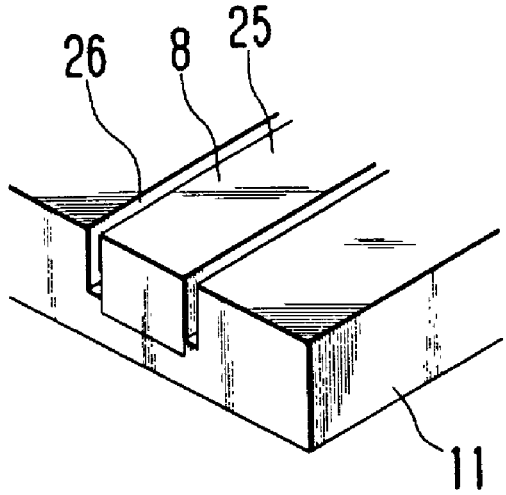
Figure 5:
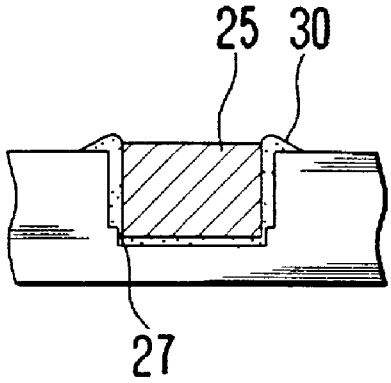
FIG. 5(A) is a front view showing an ideal embedded state of the piezoelectric body in the base member.
FIG. 5(B) is a plan view thereof.
FIG. 5(C) is a front view showing a non-uniform embedded state of the piezoelectric body in the base member.
FIG. 5(D) is a plan view thereof.
Figure 5:
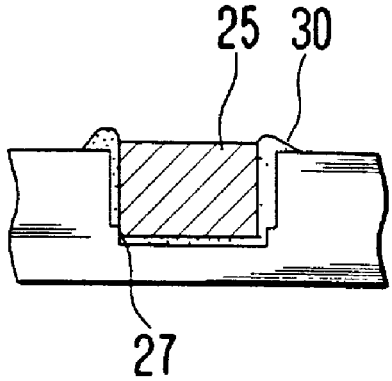
Figure 5:
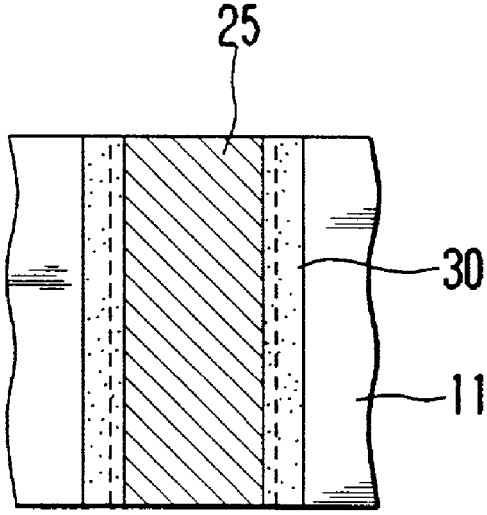
Figure 5:
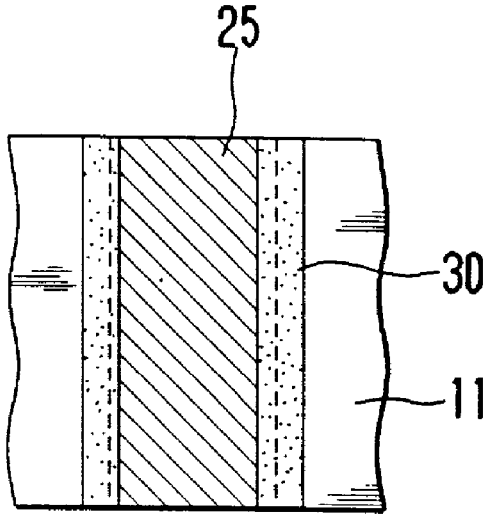

Next, with reference to FIGS. 4 to 11, the following description is provided about how to fabricate the ink jet printer head 7, especially the laminate substrate 12, shown in FIG. 2. First, in a piezoelectric body forming step B, a piezoelectric member 8 which has been polarized in the plate thickness direction is cut into a desired width to form a piezoelectric body 25. Then, in a fitting recess forming step C, a recess 26 for fitting therein of the piezoelectric body 25 is formed in a base member 11 made of a material different from the material of the piezoelectric member 8. As shown in FIG. 4, for bonding the piezoelectric body 25 to the base member 11 as a low dielectric member, it is necessary that machining be performed beforehand to form the recess 26 in the base member 11. In this machining there is used a blade 28 capable of forming both recess 26 and embedding guide groove 27 at a time, as shown in the same figure, and the recess 26 and embedding guide groove 27 are formed using a dicing saw or the like. Insofar as such a shape as in this embodiment is to be formed, it is possible to fabricate the blade 28 as an edged tool having the same sectional shape, whereby the manufacturing process can be shortened. For example, the width of the embedding guide groove 27 is 5 to 30 μm larger than the width of the piezoelectric body 25 to be embedded and the recess 26 becomes 10 to 200 μm wider than the width of the guide groove 27. As the material of the base member 11 there may be used such a ceramic material as alumina or zirconia, but a relatively soft ceramic material is easy to be machined simultaneously with PZT because PZT is relatively soft, such as a free-cutting ceramic material, magnesium titanate, boron nitride, aluminum nitride, or any of composites thereof. As a matter of course, a suitable PZT is selected mainly in consideration of piezoelectric characteristics thereof, so there is no room for selection with respect to dielectric constant, but a PZT of a smaller dielectric constant may also be selected as the material of the base member 11.

Thus, when the piezoelectric body 25 is embedded in the base member 11 formed with the recess 26 and the embedding guide groove 27 to afford a substrate 29 in a substrate forming step D, a non-uniform embedded state of the piezoelectric body 25 can be kept to a minimum by the embedding guide groove 27, as shown in FIGS. 5(A) and 5(B), whereby it becomes possible to minimize the difference between an overhanging quantity of an adhesive 30 on the right-hand side and that on the left-hand side. In addition, it is also possible to prevent the piezoelectric body 25 from being joined askew to the base member 11. That the adhesive 30 is not uniform as in FIGS. 5(C) and 5(D) causes the occurrence of a biased strain upon hardening and shrinkage of the adhesive. After the piezoelectric body 25 has been embedded in the base member 11, though a detailed description is here omitted, the adhesive 30 is allowed to cure and overhanging portions, if any, of the adhesive are removed by grinding (at this time the piezoelectric body 25 and the base member 11 are also ground partially so as to become flush with each other), but since there are no overhanging portions of the adhesive 30, the grinding quantity can be minimized.

Further, by embedding the piezoelectric body 25 in the base member 11 formed with the recess 26 and the embedding guide groove 27, the thickness of the adhesive layer present between the piezoelectric body-25 and the recess 26 of the base member 11 can be taken about 5 to 100 μm at both ends, and it becomes possible to decrease air bubbles in the adhesive layer and drop-out of the same layer though reference to the bonding method will be made later. For example, in the case where the spacing between the piezoelectric body 25 and the recess 26 is as narrow as 5 μm or less, drop-out of the adhesive layer becomes easy to occur, resulting in the occurrence of short-circuit between adjacent nozzles. In addition, although the base member 11 obstructs the motion of the piezoelectric body 25 when the latter operates, the obstruction can be diminished by interposing the adhesive layer 30, which is softer than the baser member 11, between the base member 11 and the piezoelectric body 25 at a predetermined thickness or a larger thickness, thus leading to the improvement of efficiency. As noted previously, this means that if the piezoelectric body 25 is joined askew to the base member 11, there will occur variations in the motion of the piezoelectric body. Thus, variations in thickness of the adhesive layer must be avoided.

Figure 6:
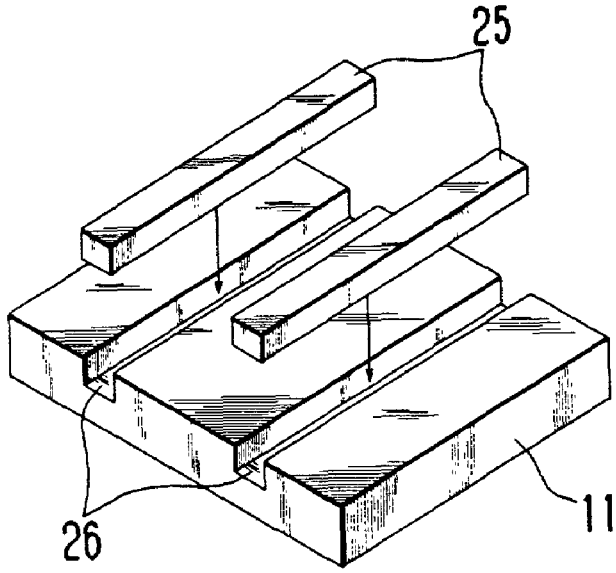
FIG. 6 is an exploded perspective view showing a relation between a base member formed with recesses and piezoelectric bodies.

FIGS. 6 to 11 illustrate an example of subsequent head fabricating steps. As shown in FIG. 6, two recesses 26 are formed in the base member 11 in the foregoing manner and piezoelectric bodies 25 are bonded respectively to the recesses 26 in such a manner as will be described later to form a substrate 29. Further, an upper surface of the substrate 29 and upper surfaces of the piezoelectric bodies 25 are made flush with each other by grinding the upper surface of the substrate as will be described later. By so doing there can be obtained four ink jet printer heads 7 from a single base member 11 as will be described later.

Figure 7:
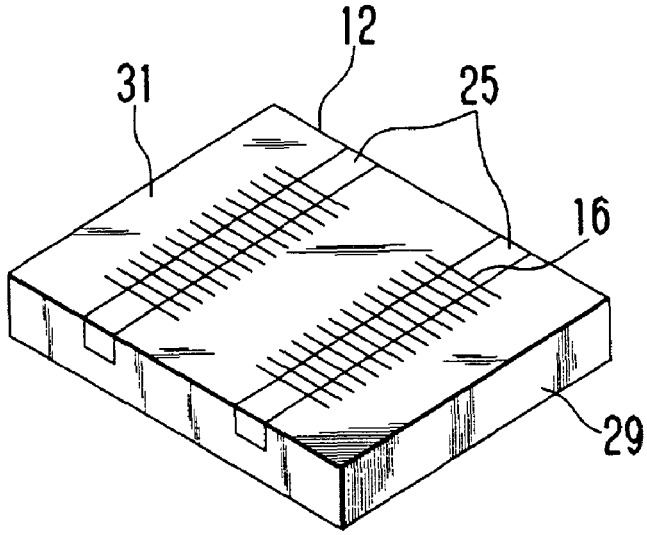
FIG. 7 is a perspective view of a grooved substrate formed by a grooving means.
Figure 8:
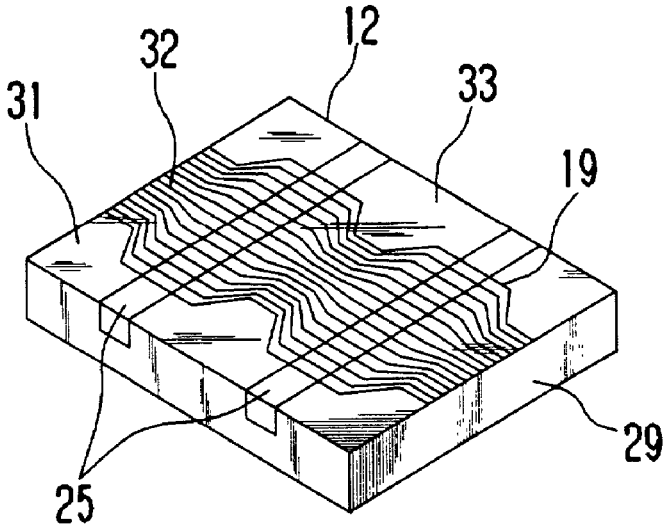
FIG. 8 is a perspective view of a head substrate formed by both head substrate forming step and electroconductive pattern forming step.
Figure 9:
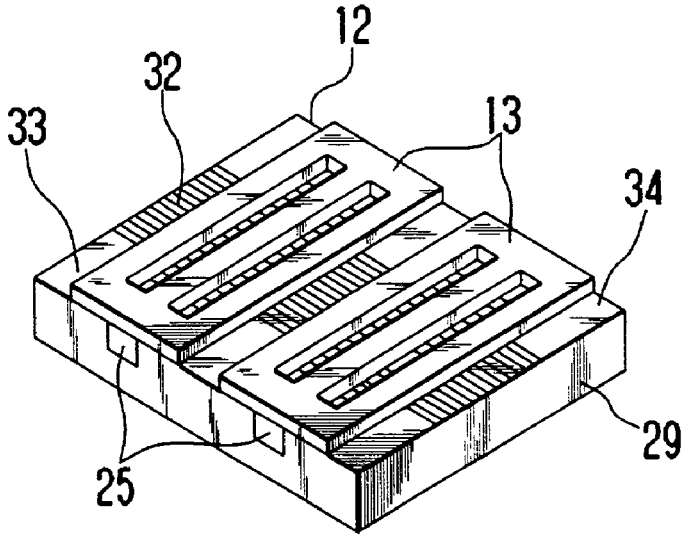
FIG. 9 is a perspective view of a head substrate-top plate composite formed by a top plate joining step.
Figure 10:
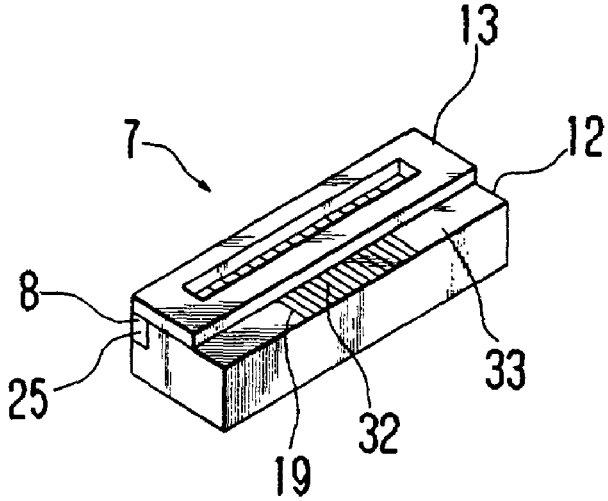
FIG. 10 is a perspective view of a had formed by a head forming step.

As shown in FIG. 7, a grooving step E is carried out in which grooves 16 are formed in the substrate 29 by means of, for example, a dicing saw or a slicer to constitute a grooved substrate 31. The size of each groove 16 is as noted previously. Thereafter, as shown in FIG. 8, a head substrate forming step F and an electroconductive pattern forming step G are executed to form an electrically conductive film 32 including electrodes 19 and wiring patterns 20 by a vacuum deposition method for example. In this way there is formed a head substrate 33 having those components. In a top plate joining step H, as shown in FIG. 9, top plates 13 are joined and fixed to the head substrate 33 to constitute a head substrate-top plates composite 34. Further, in a head forming step J, the head substrate-top plates composite 34 is divided into four such heads 35 as shown in FIG. 10.

Actually there may be used a base member 11 formed of a piezoelectric material different from that of the piezoelectric member 8 and having a dielectric constant smaller than that of the piezoelectric member 8. Generally, the piezoelectric material used as an actuator is large in both piezoelectric constant and dielectric constant. The value of a relative dielectric constant ($\epsilon_{11}T/\in_0$) is in the range of about 1,000 to 5,000. In the case where a piezoelectric material is used for the base member 11, the piezoelectric constant may be small, so there may be suitably used, for example, any of such piezoelectric materials as H8H (a product of Sumitomo Metal Industries, Ltd.; $\in_{11}T/\in_0$=520), P-4 (a product of MURATA MANUFACTURING COMPANY. ,LTD.; $\in_{11}T/\in_0$=247), and C4 (a product of Fuji Ceramics Corporation; $\in_{11}T/\in_0$=520). The use of such a piezoelectric material as the material of the base member 11 is advantageous in the following points. The capacitance of the base member 11 becomes small and so does the power consumption, thus making it possible to suppress the generation of heat from the drive circuit. Besides, because the base member 11 and the piezoelectric member 8 have similar machining characteristics, the machining for forming the grooves 16 is so much facilitated. Moreover, the thermal expansion coefficient of the base member 11 and that of the piezoelectric member 8 can be made equal to each other and therefore even if there is used a thermosetting adhesive 30, it is possible to prevent warp and deformation after the bonding.

Next, in a nozzle plate joining step K, though not specially illustrated, a nozzle plate 15 is bonded to a cut side having groove openings of the head 35 to afford such an ink jet printer head 7 as shown in FIG. 2.

Figure 11:
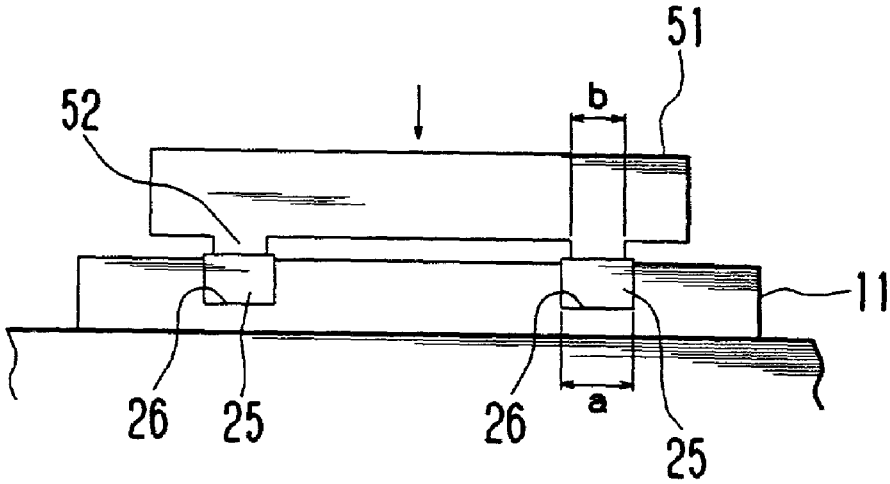
FIG. 11 is a front view showing a step of pressure-fitting piezoelectric bodies into grooves formed in the substrate.

It is preferable that the piezoelectric member 8 and the base member 11 as a low dielectric member be bonded together in a vacuum atmosphere because pores should not be present in the adhesive layer for bonding the two. More specifically, as shown in FIG. 11, an adhesive is applied to the bottom and side faces of each recess 26, then the piezoelectric member 8 is embedded and fitted in the recess 26 by a predetermined method, followed by pressure-bonding within a predetermined vacuum vessel using a pressing jig 51. As the pressing jig 51 there is used a jig of a structure in which two pressing portions 52 are projected at a height of about 2 mm, the two pressing portions 52 being spaced from each other at a spacing approximately equal to the spacing between the piezoelectric members 8 fitted respectively in the two recesses 26 of the base member 11. The piezoelectric members 8 fitted in the recesses 26 are pressed by the pressing portions 52 and are thereby bonded into the recesses 26. The width, b, of each pressing portion 52 in the pressing jig 51 is set narrower than the width, a, of each piezoelectric member 8.

In pressure-bonding the piezoelectric members 8 into the recesses 26, as noted previously, the use of a predetermined vacuum atmosphere is essential for the removal of air bubbles from the adhesive because the spacing between each recess 26 formed in the base member 11 and each piezoelectric member 8 embedded therein is about 5 to 30 μm and is thus very narrow. If the width, b, of each pressing portion 52 in the pressing jig 51 is set larger than the width, a, of each piezoelectric member 8, the pressing portion 52 comes to be positioned above the gap between the recess 26 and the piezoelectric member 8 embedded therein, so that the degassing resistance of air bubbles increases, and even if vacuum degassing is performed over a considerably long period of time, a portion of air bubbles present in the adhesive may remain unremoved. In contrast therewith, since in this embodiment the width, b, of each pressing portion 52 of the pressing jig 51 is set narrower than the width, a, of each piezoelectric member 8, the pressing portions 52 of the pressing jig 51 do not obstruct the removal of air bubbles and it becomes possible to form an air bubble-free adhesive layer between each recess 26 and each piezoelectric member 8 embedded therein.

Besides, the pressing portions 52 of the pressing jig 51 are projected at a height of about 2 mm, so in carrying out the pressing work for the piezoelectric members 8 with use of the pressing jig 51 there is formed a gap between the base member 11 and the pressing jig 51, whereby the degassing efficiency is improved for the air bubbles present in the gap between each recess 26 and each piezoelectric member 8 embedded therein.

Thus, according to this embodiment, after the adhesive present in the gap between each recess 26 and each piezoelectric member 8 embedded therein has been cured, there no longer remain any air bubbles in the adhesive layer, whereby an electrode shorting which may be caused by air bubbles remaining in the adhesive layer is sure to be prevented.

After completion of the pressure-bonding of the piezoelectric members 8 to the recesses 26, overhanging portions of the adhesive overhanging onto the upper surface of the base member 11 are removed by grinding for example, whereby the substrate forming step D is completed.

The second embodiment of the present invention will be described below with reference to FIGS. 12 to 21, in which the same portions as in the first embodiment will be identified by the same reference numerals as in the first embodiment.

Figure 12:
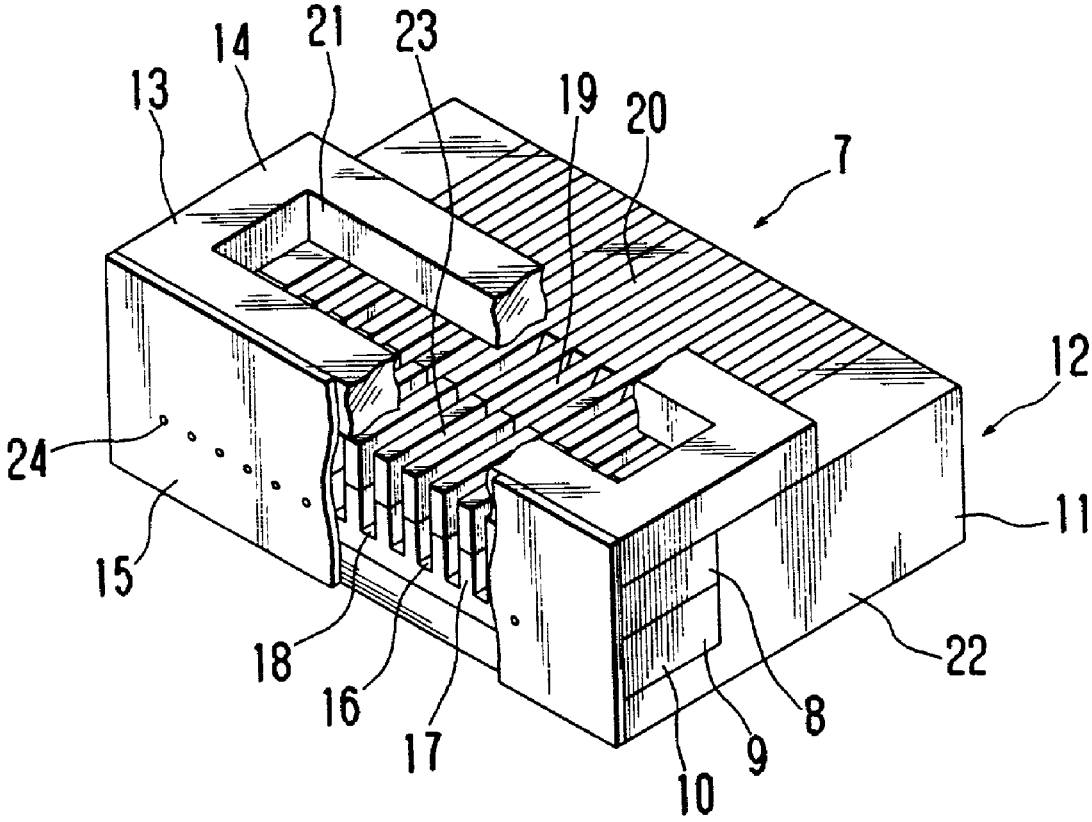
FIG. 12 is a partially cut-away perspective view of an ink jet printer head according to the second embodiment of the present invention.

According to the structure of an ink jet printer head 7 of this embodiment, as shown in FIG. 12, a laminated piezoelectric member 10 comprising piezoelectric members 8 and 9 each formed of a piezoelectric material such as PZT (lead zirco-titanate) is cut into predetermined shape and size to form a piezoelectric body 25. The piezoelectric body 25 is combined with a base member 11 formed of a material smaller in dielectric constant than the piezoelectric members 8 and 9 to constitute a laminate substrate 12, the laminate substrate 12 and a top plate 13 are then bonded or joined together to afford a laminate substrate-top plate composite 14, and a nozzle plate 15 about 10 to 100 μm thick is bonded integrally to the laminate substrate-top plate composite 14.

The two piezoelectric members 8 and 9 formed of PZT have been polarized vertically in opposite directions, and in the laminate substrate with the laminated piezoelectric member 10 incorporated therein are formed a large number of grooves 16 extending from an upper surface of the piezoelectric member 8 located at an upper position and reaching the interior of the piezoelectric member 9 located at a lower position, the grooves 16 being open on a front side and closed on a rear side. The grooves 16 are formed in parallel by grinding with use of, for example, a diamond wheel of a dicing saw used for cutting an IC wafer. Support walls 17 each formed between adjacent grooves 16 serve as drive portions for pressure generating means 18 and are in a shape equal to the shape of the grooves 16. The size of each groove 16 differs, depending on the specification of the ink jet printer head 7, but, for example, it is 0.2 to 1 mm deep, 20 to 200 μm wide, and 1 to 20 mm long.

Figure 13:
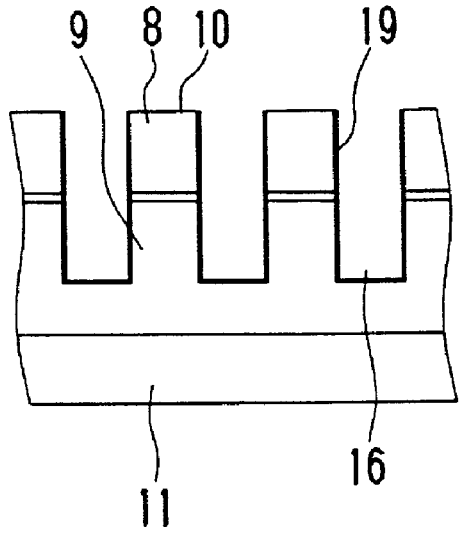
FIG. 13 is a front view showing grooves formed in the substrate and electrodes formed in the grooves.

As shown in FIG. 13, electrodes 19 are formed on inner surfaces of the grooves 16 by, for example, a vacuum deposition method or an electroless nickel plating method. The electrodes 19 are extended from rear portions of the grooves 16 up to an upper surface of the base member 11. At the same time, wiring patterns 20 are formed, for example, by vacuum deposition or electroless plating. Electroless plating permits easy formation of a metallic film even within such fine grooves 16. Although nickel is used in this embodiment, gold or copper may be used, and films of two or more such metals may be laminated together.

The top plate 13 has such a hollow portion as shown in FIG. 12, which hollow portion serves as an ink reservoir 21 communicating with rear ends of the grooves 16 in the laminate substrate 12. The top plate 13 is bonded to the laminate substrate 12 using an adhesive or the like to afford a laminate substrate-top plate composite 22, and the nozzle plate 15 is bonded integrally to the front side of the laminate substrate-top plate composite with an adhesive. The grooves 16 whose front and upper sides are thus closed with the nozzle plate 15 and the top plate 13 respectively are used as pressure chambers 23 which also serve as ink flow paths, with ink being fed into the pressure chambers 23 through the ink reservoir 21.

As to the ink reservoir 21, a cover plate having an opening which permits introduction of ink from the exterior may be bonded to the ink reservoir, or there may be used a plate of a shape which covers the ink reservoir. Since a rear portion of an upper surface of the laminate substrate 12 is exposed behind the top plate 13, a drive circuit can be connected through an FPC or the like to the wiring patterns 20 positioned in the rear portion.

In the ink jet printer head 7 thus constructed, with ink fed into the pressure chambers 23, the support walls 17 positioned on both sides of each pressure chamber 23 to be driven are bent away from each other gradually by a shear mode deformation of the piezoelectric members 8 and 9 which are polarized in opposite directions and are then restored to their initial positions to pressurize the ink present within the pressure chamber 23, thereby causing an ink droplet to be jetted from an associated ink jet orifice 24 formed in the nozzle plate 15. In this case, for the prevention of crosstalk, the support walls 17 of the pressure generating means 18 are driven so as to pressurize even-number pressure chambers 23 and odd-number pressure chambers 23 in an alternate manner. In the ink jet printer head 7 being considered, since ink jet orifices 24 formed in the nozzle plate 15 are expanded at their rear portions and tapered at their front portions, the ink pressurized in each pressure chamber 23 can be jetted efficiently.

Figure 14:
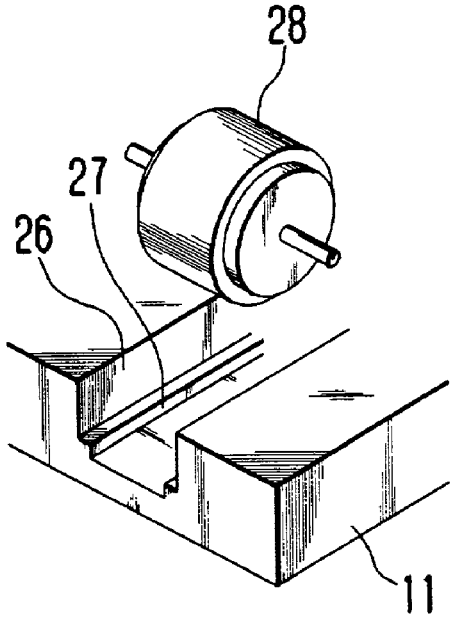
FIG. 14(A) is a perspective view showing a grooving step.
FIG. 14(B) is a perspective view showing a head substrate forming step in which a piezoelectric body is joined and fixed to a base member.
Figure 14:
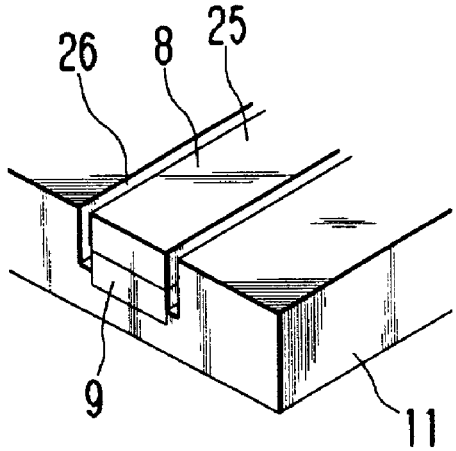

Next, with reference to FIGS. 13 to 21, a description will now be given of a method for fabricating the ink jet printer head 7, especially the laminate substrate 12, shown in FIG. 12. First, in a piezoelectric member joining step A, two piezoelectric members 8 and 9 which have been polarized are joined together so that respective poles are opposed to each other. Then, in a piezoelectric body forming step B, the thus-joined piezoelectric members 8 and 9 are cut into a desired width to form a piezoelectric body 25. Next, in a fitting recess forming step C, a recess 26 for fitting therein of the piezoelectric body 25 is formed in the base member 11 made of a material different from the material of the piezoelectric members 8 and 9. As shown in FIG. 14, for bonding the piezoelectric body 25 to the base member 11 which is a low dielectric member, it is necessary to machine the base member 11 beforehand for forming the recess 26. In this machining there is used a blade 28 capable of forming both recess 26 and embedding guide groove 27 at a time, as shown in the same figure, and the recess 26 and embedding guide groove 27 are formed using a dicing saw or the like. As long as such a shape as in this embodiment is to be formed, it is possible to fabricate the blade 28 as an edged tool having the same sectional shape, whereby the manufacturing process can be shortened. For example, the width of the embedding guide groove 27 is 5 to 30 μm larger than the width of the piezoelectric body 25 to be embedded and the recess 26 becomes 10 to 200 μm wider than the embedding guide groove 27. As the material of the base member 11 there may be used such a ceramic material as alumina or zirconia, but a relatively soft ceramic material is easy to be machined simultaneously with PZT because PZT is relatively soft, such as a free-cutting ceramic material, magnesium titanate, boron nitride, aluminum nitride, or any of composites thereof. As a matter of course, a suitable PZT is selected mainly in consideration of piezoelectric characteristics thereof, with no room for selection with respect to dielectric constant, but a PZT of a smaller dielectric constant may also be selected as the material of the base member 11. In this embodiment, the ink jet printer head 7 is obtained using the laminate substrate 12 thus formed and through the same steps as in the first embodiment.

Figure 15A:
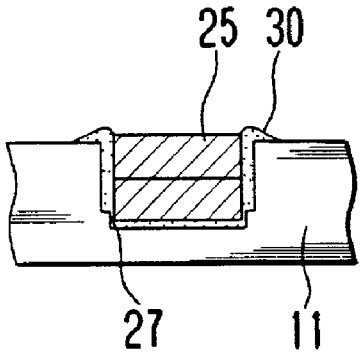
FIG. 15(A) is a front view showing an ideal embedded state of the piezoelectric body in the base member.
Figure 15C:
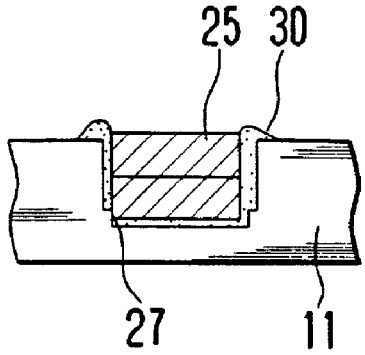
FIG. 15(C) is a front view showing a non-uniform embedded state of the piezoelectric body in the base member.
Figure 15B:
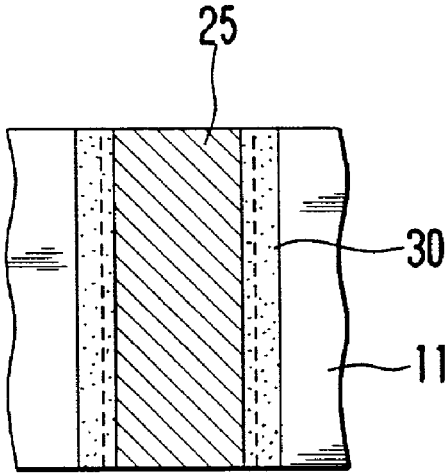
FIG. 15(B) is a plan view thereof.
Figure 15D:
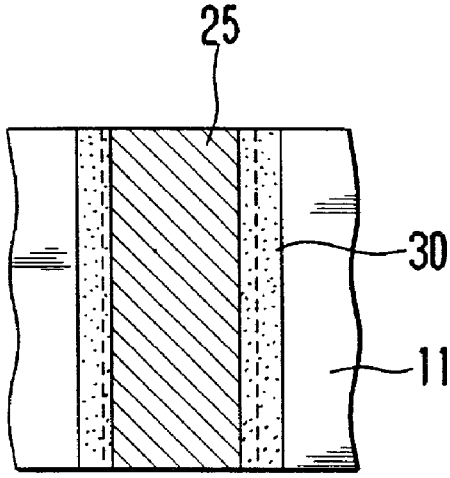
FIG. 15(D) is a plan view thereof.

When the piezoelectric body 25 is embedded in the base member 11 formed with the recess 26 and the embedding guide groove 27 to afford a substrate 29 in a substrate forming step D, a non-uniform embedded state of the piezoelectric body 25 can be kept to a minimum by the embedding guide groove 27, as shown in FIGS. 15(A) and 15(B), whereby not only it becomes possible to minimize the difference between an overhanging quantity of an adhesive 30 on the right-hand side and that on the left-hand side, but also it is possible to prevent the piezoelectric body 25 from being joined askew to the base member 11. Such a non-uniform state of the adhesive 30 as in FIGS. 15(C) and 15(D) causes the occurrence of a biased strain when the adhesive shrinks on hardening. After embedding of the piezoelectric body 25 in the base member 11, though a detailed description is here omitted, the adhesive 30 is allowed to cure and overhanging portions, if any, of the adhesive are removed by grinding (at this time the piezoelectric body 25 and the base member 11 are also ground partially so as to become flush with each other), but since there are no overhanging portions of the adhesive 30, the grinding quantity can be minimized.

Moreover, since the piezoelectric body 25 is embedded in the base member 11 with both recess 26 and embedding guide groove 27 formed therein, the thickness of the adhesive layer present between the piezoelectric body 25 and the recess 26 of the base member 11 can be taken about 5 to 100 μm, thus making it possible to decrease air bubbles in the adhesive layer and drop-out of the same layer, though a description of the bonding method will be given later. For example, where the spacing between the piezoelectric body 25 and the recess 26 is as narrow as 5 μm or less, it becomes easy for drop-out of the adhesive layer to occur, with consequent occurrence of short-circuit between adjacent nozzles. Additionally, although the base member 11 obstructs the motion of the piezoelectric body 25 during operation of the latter, the obstruction can be diminished by interposing the adhesive layer 30, which is softer than the base member 11, between the base member 11 and the piezoelectric body 25 at a predetermined thickness or a larger thickness, thus permitting the improvement of efficiency. As noted in the previous description, this means that if the piezoelectric body 25 is joined askew to the base member 11, there will occur variations in the motion of the piezoelectric body. Therefore, it is necessary to avoid variations in thickness of the adhesive layer.

Figure 16:
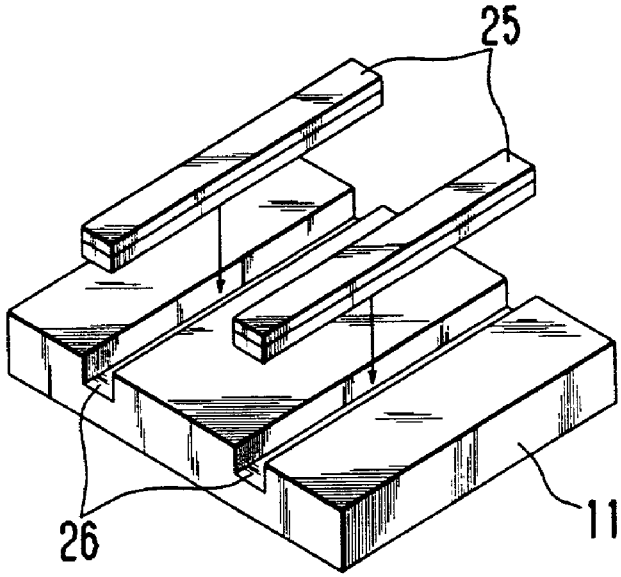
FIG. 16 is an exploded perspective view showing a relation between a base member formed with recesses and piezoelectric bodies.

FIGS. 16 to 21 illustrate an example of subsequent head fabricating steps. As shown in FIG. 16, two recesses 26 are formed in the base member 11 in the manner described above and piezoelectric bodies 25 are bonded to the recesses 26 respectively in a manner to be described later to form a substrate 29. Further, an upper surface of the substrate 29 is subjected to grinding to make it flush with the piezoelectric bodies 25 as will be described later. In this way four ink jet printer heads 7 can be obtained from a single base member 11 as will be shown later.

Figure 17:
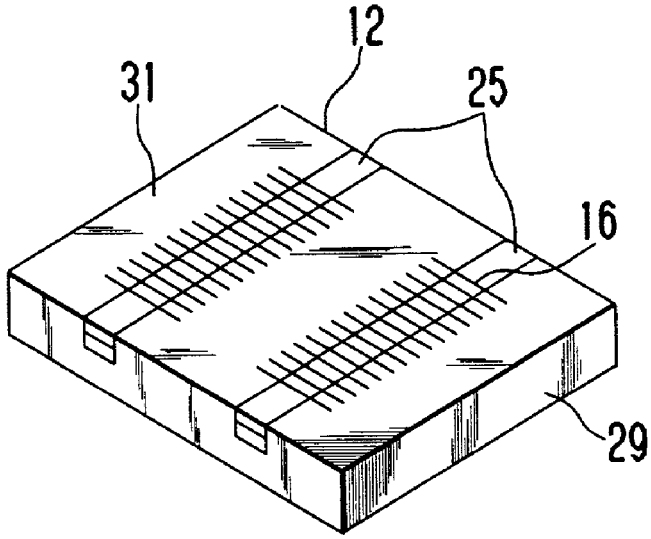
FIG. 17 is a perspective view of a grooved substrate formed by a grooving means.
Figure 18:
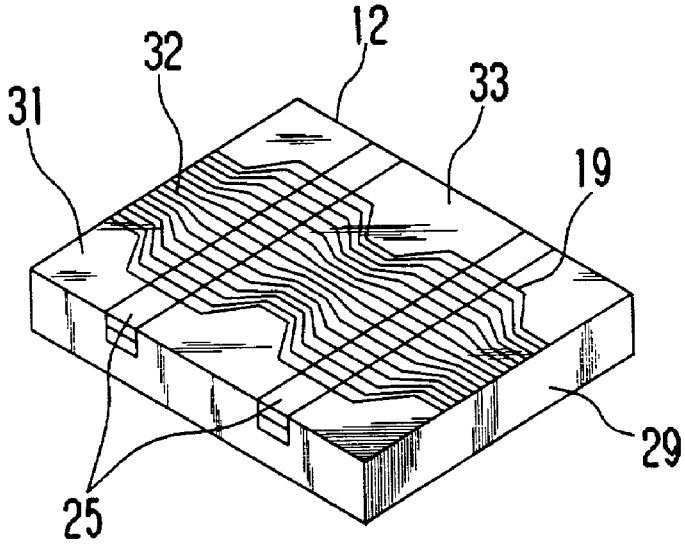
FIG. 18 is a perspective view of a head substrate formed by both head substrate forming step and electroconductive pattern forming step.
Figure 19:
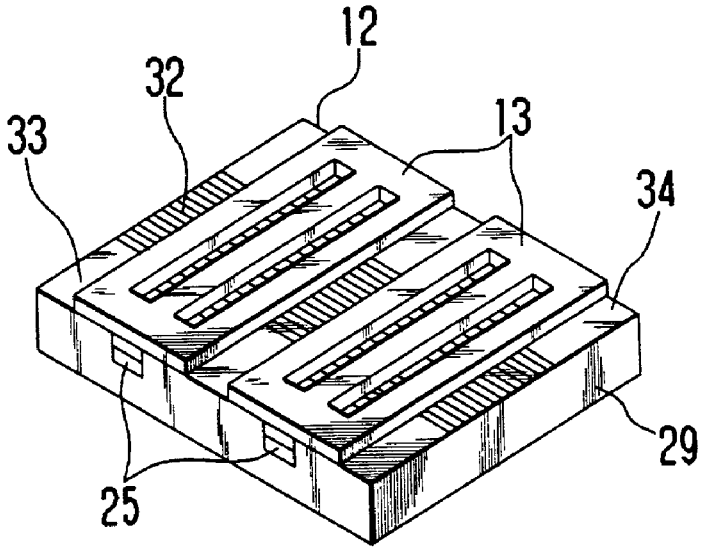
FIG. 19 is a perspective view of head substrate-top plate composite formed by a top plate joining step.
Figure 20:
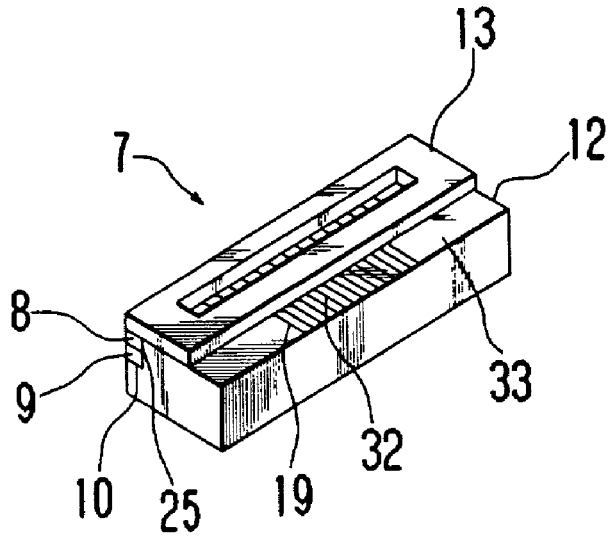
FIG. 20 is a perspective view of a head formed by a head forming step.

As shown in FIG. 17, a grooving step E is carried out in which grooves 16 are formed in the substrate 29 using, for example, a dicing saw or a slicer to afford a grooved substrate 31. The size of each groove 16 is as mentioned previously. This grooving step is followed by a head substrate forming step F and an electroconductive pattern forming step G, in which an electrically conductive film 32 including electrodes 19 and wiring patterns 20 is formed by, for example, a vacuum deposition method or an electroless plating method. In this way a head substrate having those components is formed. Then, in a top plate joining step H, as shown in FIG. 19, a top plate 13 is joined and fixed to the head substrate 33 to form a head substrate-top plate composite 34. Further, in a head forming step J, the head substrate-top plate composite 34 is divided into four such heads 35 as shown in FIG. 20.

There actually may be used a base member 11 formed of a piezoelectric material different from that of the piezoelectric members 8 and 9 and having a dielectric constant smaller than that of the piezoelectric members 8 and 9. Generally, the piezoelectric material used as an actuator has a large piezoelectric constant and the dielectric constant thereof is also large. The value of a relative dielectric constant ($\in_{11}T/\in_0$) is about 1,000 to 5,000. Where a piezoelectric material is used for the base member 11, the piezoelectric constant may be small and therefore, for example, H8H (a product of Sumitomo Metal Industries, Ltd.; $\in_{11}T/\in_0=520$), P-4 (a product of MURATA MANUFACTURING COMPANY., LTD.; $\in_{11}T/\in_0=247$), or C4 (a product of Fuji Ceramics Corporation; $\in_{11}T/\in_0=520$) may be used suitably. By using such a piezoelectric material as the material of the base member 11 the capacitance of the base member becomes small, with consequent reduction of power consumption, whereby it is possible to suppress the generation of heat from the drive circuit. Moreover, since the base member 11 and the piezoelectric members 8, 9 have similar machining characteristics, the machining for forming the grooves 16 is so much facilitated. Besides, the thermal expansion coefficient of the base member 11 and that of the piezoelectric members 8, 9 can be made equal to each other, thus making it possible to prevent warp and deformation after the bonding.

Then, in a nozzle plate joining step K, though not specially illustrated, a nozzle plate 15 is bonded to a cut side having groove openings of the head 35 to form such an ink jet printer head 7 as shown in FIG. 12.

According to electroless plating, an electrically conductive film 32 can be formed also within such fine grooves 16 as in this embodiment, but even if there are such very fine pores as provide communication of the grooves 16 adjacent to support walls 17, a plating film will be deposited within the pores and will cause a short-circuit of patterns. Therefore, pores larger than the width of each support wall 17 must not be present in the piezoelectric members 8, 9 and the base member 11. Usually, etching is performed prior to electroless plating, but the expansion of a pore or communication of plural pores by the etching and eventual increase in size of the pore to a larger size than the width of each support wall 17 must be avoided. To meet these requirements it is necessary to select a material of very small pores.

For the same reason, pores must not be present in the adhesive layer when bonding the two piezoelectric members 8 and 9 together to form a laminated piezoelectric member 10. It is preferable that after the application of an adhesive 30 and before lamination the two piezoelectric members be placed in a vacuum atmosphere and laminated together in the same atmosphere. Pores, if any, in the adhesive layer are air bubbles present in the interior of the adhesive 30 and air bubbles mixed into the adhesive layer at the time of lamination. The former are degassed by the vacuum atmosphere before lamination and the latter are not mixed into the adhesive layer because air is not present (very small in quantity) at the time of lamination (air bubbles are reduced in size and become very small upon release to the air). The vacuum atmosphere is set at an appropriate degree of vacuum taking the width of each support wall 7 and the viscosity of the adhesive 30 into account. The higher the degree of vacuum (close to vacuum), the smaller the air bubbles, but the apparatus becomes larger in size and a longer time is required, so it is desirable to balance these points and decide an appropriate value. In such a bonding method the adhesive 30 overhangs to the peripheral edge portion, so it is preferable that two large piezoelectric members be first laminated together and then cut into the laminated piezoelectric member 10.

Figure 21:
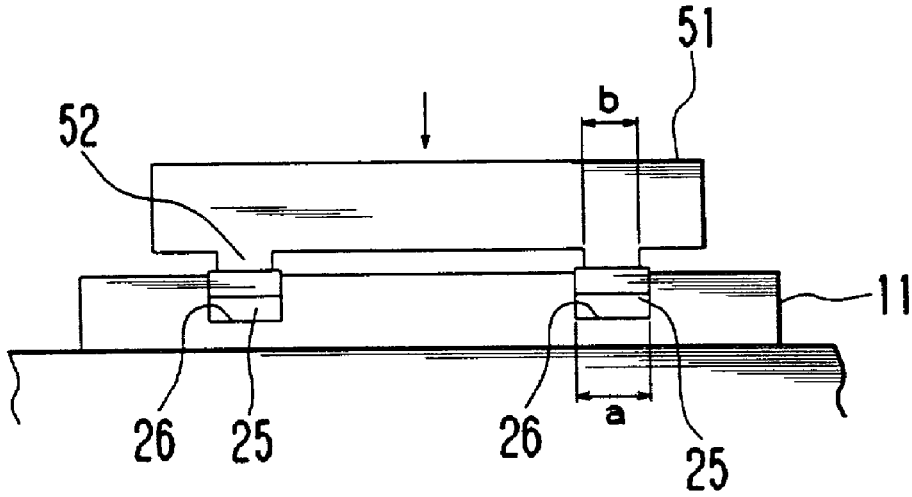
FIG. 21 is a front view showing a step of pressure-fitting piezoelectric bodies into grooves formed in the substrate.

Further, for the same reason as above; pores must not be present, either, in the adhesive layer used for bonding the laminated piezoelectric member 10 to the base member 11 as a low dielectric member. Therefore, it is preferable that both be laminated together in a vacuum atmosphere. To be more specific, as shown in FIG. 21, an adhesive is applied to the bottom and side faces of each recess 26, then the piezoelectric member 8 is embedded and fitted in the recess 26 by a predetermined method, followed by pressure-bonding within a predetermined vacuum vessel using a pressing jig 51. As the pressing jig 51 there is used a jig of a structure in which two pressing portions 52 are projected at a height of about 2 mm, the two pressing portions 52 being spaced from each other at a spacing approximately equal to the spacing between the piezoelectric members 8 fitted respectively in the two recesses 26 of the base member 11. The piezoelectric members 8 fitted in the recesses 26 are pressed by the pressing portions 52 and are thereby bonded into the recesses 26. The width, b, of each pressing portion 52 in the pressing jig 51 is set narrower than the width, a, of each piezoelectric member 8.

In pressure-bonding the piezoelectric members 8 into the recesses 26, as mentioned previously, since the spacing between each recess 26 formed in the base member 11 and each piezoelectric member 8 embedded therein is very narrow, about 5 to 30 μm, the use of a predetermined vacuum atmosphere is essential for the removal of air bubbles from the adhesive. If the width, b, of each pressuring portion 52 in the pressing jig 51 is set larger than the width, a, of each piezoelectric member 8, the pressing portion 52 comes to be positioned above the gap between the recess 26 and the piezoelectric member 8 embedded therein, resulting in increase in the degassing resistance of air bubbles, and even if vacuum degassing is performed over a considerably long period of time, a portion of air bubbles present in the adhesive may remain unremoved. But in this embodiment the width, b, of each pressing portion 52 in the pressing jig 51 is set narrower than the width, a, of each piezoelectric member 8, therefore, the pressing portions 52 of the pressing jig 51 are not an obstacle to the removal of air bubbles and it becomes possible to form an air bubble-free adhesive layer between each recess 26 and each piezoelectric member 8 embedded therein.

Additionally, the pressing portions 52 of the pressing jig 51 are projected at a height of about 2 mm, so in carrying out the pressing work for the piezoelectric members 8 with use of the pressing jig 52 there is formed a gap between the base member 11 and the pressing jig 51, whereby the degassing efficiency is improved for the air bubbles present in the gap between each recess 26 and each piezoelectric member 8 embedded therein.

Thus, according to this embodiment, after curing of the adhesive present in the gap between each recess 26 and each piezoelectric member 8 embedded therein, air bubbles no longer remain in the adhesive layer, whereby an electrode shorting which may be caused by residual air bubbles in the adhesive layer is surely prevented.

After the pressure-bonding of the piezoelectric members 8 to the recesses 26, overhanging portions of the adhesive overhanging onto the upper surface of the base member 11 are removed by grinding for example, whereby the substrate forming step D is completed.

In the former bonding of two sheets of PZT, the bonding can be done easily in a vacuum atmosphere because of a simple shape, but in the latter case of embedding the mechanism used becomes large-scaled. Though depending on the shape and size and the type of an adhesive used, if the adhesive used is a thermosetting epoxy adhesive, the viscosity thereof decreases before curing, so if the bonding area is narrow and the bonding layer is thick, curing may be allowed to take place in vacuum, even without conducting lamination in vacuum, whereby air bubbles incorporated at the time of lamination will be removed, thus making it possible to effect poreless bonding. This method may therefore be adopted.

Figure 22:
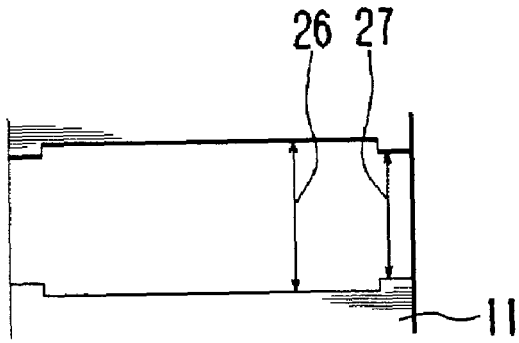
FIG. 22(A) is a plan view of a base member used in the third embodiment of the present invention.
FIG. 22(B) is a plan view showing an embedded state of a piezoelectric body.
Figure 22:
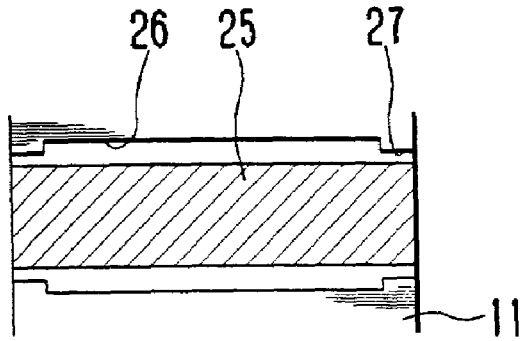

Next, the third embodiment of the present invention will now be described with reference to FIG. 22, in which the same portions as in the first and second embodiments will be identified by the same reference numerals as in the previous embodiments and explanations thereof will be omitted. In this third embodiment, which is a modification in shape of the recess 26, narrow portions serving as embedding guide grooves 27 are formed respectively on both sides of a base member 11, while in the depth direction are formed uniform grooves 16. Although reference has just been made to a uniform depth, it goes without saying that a difference in height or a rounded portion, which are formed in machining, may be present insofar as it does not depart from the object of the present invention. This shape means that the width of a recess 26 located at a position where the grooves 16 of a grooved substrate 31 are not formed is smaller than the width of a recess 26 located at a position where the grooves 16 are formed.

Figure 23:
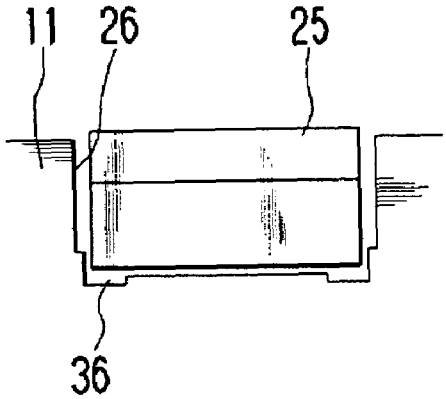
FIG. 23(A) is a side view showing the fourth embodiment of the present invention in which reliefs are formed in the bottom of a recess.
FIG. 23(B) is a side view showing a state in which reliefs are formed in the bottom of an embedding guide groove.
Figure 23:
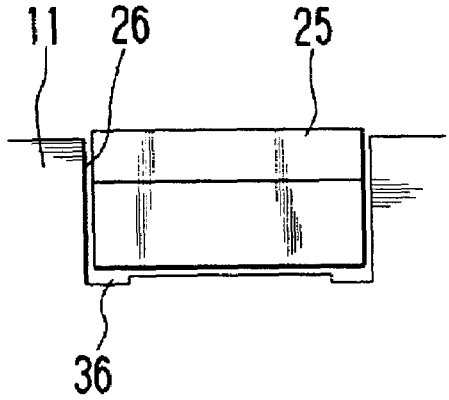

The fourth embodiment of the present invention will now be described with reference to FIG. 23, in which the same portions as in the first and second embodiments will be identified by the same reference numerals as in those embodiments and explanations thereof will be omitted. In the case where a recess 26 is formed using a diamond blade 28, the bottom of each groove 16 may be rounded unless truing is conducted at every grinding operation. Once such a rounded portion is formed, the position in which a piezoelectric body 25 is to be embedded is not determined accurately or the depth at which it is embedded becomes no longer uniform. Forming reliefs 36 at corner portions of the bottom of the recess, as in FIGS. 23(A) and 23(B), is effective in avoiding such inconveniences. The reliefs 36 correspond to the difference in height in the present invention, concave and convex in the present invention, and chamber in the present invention. The recess 26 may be in such a tapered shape as in the present invention. But it goes without saying that the difference in height in the present invention, the concave and convex in the present invention, and the chamfer in the present invention are not limited to the reliefs 36.

Although the piezoelectric body 25 illustrated in the drawing and referred to above in connection with this embodiment corresponds to the piezoelectric body 25 described in the second embodiment, the piezoelectric body 25 described in the first embodiment is also applicable to this embodiment.

Figure 24A:
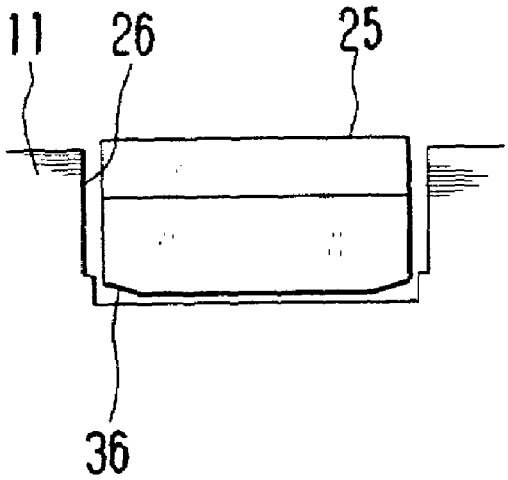
FIG. 24(A) is a side view showing the fifth embodiment of the present invention in which reliefs are formed at corner portions of a piezoelectric body.
Figure 24B:
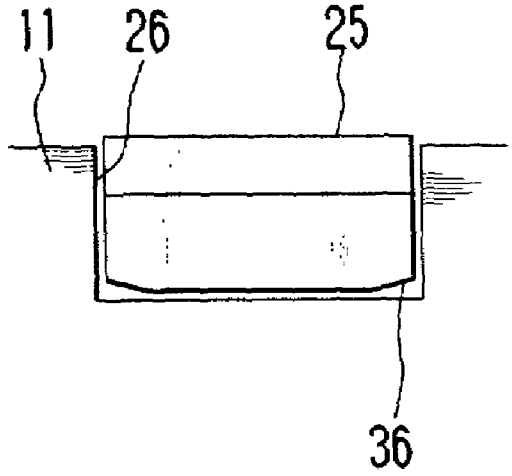
FIG. 24(B) is a side view showing a relation to an embedding guide groove.

The fifth embodiment of the present invention will now be described with reference to FIG. 24, in which the same portions as in the first and second embodiments will be identified by the same reference numerals as in those previous embodiments and explanations thereof will be omitted. In this embodiment, which corresponds to a modification of the fourth embodiment, reliefs 36 are provided on the piezoelectric body 25 side instead of forming such reliefs 36 as shown in FIG. 23 on the recess 26 side.

Although the piezoelectric body 25 illustrated in the drawing and referred to above in connection with this fifth embodiment corresponds to the piezoelectric body 25 described in the second embodiment, it goes without saying that the piezoelectric body 25 described in the first embodiment is also applicable to this embodiment.

As set forth above, in one aspect of the present invention there is provided an ink jet printer head fabricating method comprising a piezoelectric member joining step of joining two pre-polarized piezoelectric members so that respective poles are opposed to each other, a piezoelectric body forming step of cutting the thus-joined piezoelectric members into a desired width to form a piezoelectric body, a fitting recess forming step of forming a recess for fitting therein of the piezoelectric body in a base member formed of a material different from the material of the piezoelectric member, a substrate forming step of embedding the piezoelectric body into the recess to form a substrate, a grooving step of forming a plurality of desired grooves in parallel in the piezoelectric body-embedded side of the substrate to form a grooved substrate, a head substrate forming step of forming an electrically conductive film on inner walls of at least the grooves including two such piezoelectric members in the grooved substrate to form a head substrate, an electroconductive pattern forming step of making connection to the electrically conductive film for the application of voltage thereto, a top plate joining step of joining a top plate to the head substrate to form a head substrate-top plate composite, a head forming step of cutting the head substrate-top plate composite at a desired position to form a head, and a nozzle plate joining step of joining a nozzle plate to a cut side having groove openings of the head. This method is superior in mass-productivity because a plurality of ink jet printer heads can be obtained from a single substrate.

In another aspect of the present invention there is provided an ink jet printer head fabricating method comprising a piezoelectric body forming step of cutting two pre-polarized piezoelectric members into a desired width to form a piezoelectric body, a fitting recess forming step of forming a recess for fitting therein of the piezoelectric body in a base member formed of a material different from the material of the piezoelectric member, a substrate forming step of embedding the piezoelectric body into the recess to form a substrate, a grooving step of forming a plurality of desired grooves in parallel in the piezoelectric body-embedded side of the substrate to form a grooved substrate, a head substrate forming step of forming an electrically conductive film on inner walls of at least the grooves of the grooved substrate to form a head substrate, an electroconductive pattern forming step of making connection to the electrically conductive film for the application of voltage thereto, a top plate joining step of joining a top plate to the head substrate to form a head substrate-top plate composite, a head forming step of cutting the head substrate-top plate composite at a desired position to form a head, and a nozzle plate joining step of joining a nozzle plate to a cut side having groove openings of the head. This method is also superior in mass-productivity because a plurality of ink jet printer heads can be obtained from a single substrate.

Where the dielectric constant of the base member is set smaller than that of the piezoelectric member, the power consumption is small because the capacitance of the base member is small, thus making it possible to suppress the generation of heat from the drive circuit. Besides, because the base member and the piezoelectric member exhibit similar machining characteristics in forming grooves, the grooving work is so much facilitated. Moreover, the thermal expansion coefficient of the base member and that of the piezoelectric member can be made equal to each other and therefore it is possible to prevent warp and deformation after the bonding even if there is used a thermosetting adhesive.

Where there is used a base member 11 formed of a piezoelectric material different from that of the piezoelectric member 8 and having a dielectric constant smaller than that of the piezoelectric member 8, the power consumption is reduced because of a small capacitance of the base member, and therefore it is possible to suppress the generation of heat from the drive circuit. Besides, since the base member and the piezoelectric member exhibit similar machining characteristics in forming grooves, the grooving work is so much facilitated. Additionally, the thermal expansion coefficient of the base member and that of the piezoelectric member can be made equal to each other and the use of a thermosetting adhesive permits prevention of warp and deformation after the bonding.

Where the electrically conductive film is formed by electroless plating, an electrode having a required thickness can be easily formed within a fine groove.

Where the piezoelectric member joining step is carried out in a vacuum atmosphere, air bubbles or the like are no longer generated in the adhesive layer, so when electrodes are formed within grooves, there is no fear of occurrence of a short-circuit with adjacent elements or an open circuit caused by unsatisfactory connection of the electrodes on the adhesive layer.

Where the recess is formed by an edged tool having a sectional shape of the recess, it becomes easy to form a recess of a complicated shape having a difference in height for example.

If a step of pouring a predetermined amount of an adhesive into the recess formed in the base member and embedding the piezoelectric member into the recess and a step of pressing the piezoelectric body with a pressing jig having a pressing portion whose width is smaller than the width of the recess, are included in the substrate forming step, it is possible to improve the degassing efficiency for air bubbles from the gap present between the recess and the piezoelectric body embedded therein. Consequently, it is possible to prevent air bubbles from remaining in the adhesive layer which is formed in the gap and thereby surely prevent an electrode shorting which might occur if there remained air bubbles in the adhesive layer.

In a further aspect of the present invention there is provided an ink jet printer head comprising a head substrate formed by the steps of cutting two piezoelectric members which have been joined so that respective poles are opposed to each other into a desired width to form a piezoelectric body, embedding the piezoelectric body into a recess of a base member formed of a material different from the material of the piezoelectric member to form a substrate, forming a plurality of desired grooves in the piezoelectric body-embedded side of the substrate, and forming an electrically conductive film on inner walls of the grooves; a top plate joined to one side of the head substrate; and a nozzle plate joined to an open side of the grooves, the nozzle plate having ink jet orifices formed respectively for the grooves. This construction permits a plurality of ink jet printer heads to be obtained from a single substrate and is thus superior in mass-productivity.

In a still further aspect of the present invention there is provided an ink jet printer head comprising a head substrate formed by the steps of cutting a pre-polarized piezoelectric member into a desired width to form a piezoelectric body, embedding the piezoelectric body into a recess of a base member formed of a material different from the material of the piezoelectric member to form a substrate, forming a plurality of desired grooves in the piezoelectric body-embedded side of the substrate, and forming an electrically conductive film on inner walls of the grooves; a top plate joined to one side of the head substrate; and a nozzle plate joined to an open side of the grooves, the nozzle plate having ink jet orifices formed respectively for the grooves.

This construction also permits a plurality of ink jet printer heads to be obtained from a single substrate and is thus superior in mass-productivity.

Where the dielectric constant of the base member is set smaller than that of the piezoelectric member, it is possible to enhance the energy efficiency to an extremely great extent.

Where there is used a base member formed of a piezoelectric material different from that of the piezoelectric member and having a dielectric constant smaller than that of the piezoelectric member, the power consumption is small because of a small capacitance of the base member, thus making it possible to suppress the generation of heat from the drive circuit. Besides, since the base member and the piezoelectric member have similar machining characteristics in the grooving work, the grooving work is so much facilitated. Moreover, the thermal expansion coefficient of the base member and that of the piezoelectric member can be made equal to each other and therefore it is possible to prevent warp and deformation after bonding even with use of a thermosetting adhesive.

Since the recess has one or more stepped or tapered portions, the adhesive layer present between the piezoelectric body and the base member is restricted by the stepped portions of the recess and the thickness thereof can be made uniform, so that it is possible to prevent variations in deformation of the piezoelectric body caused by variations in thickness of the adhesive layer.

Where the width of the recess at a groove-free position of the grooved substrate is set smaller than the width of the recess at the groove-formed position, the positioning of the piezoelectric body can be done accurately in this narrow portion, whereby it is possible to eliminate displacement of the adhesive layer.

Where concave and convex are formed on the bottom of the recess, the position of the piezoelectric body relative to the base member can be determined accurately.

Where corner portions of the bottom of the recess are chamfered, it is possible to accurately determine the position of the piezoelectric body relative to the base member.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to e embraced therein.

The present application is based on Japanese Priority Document Hei 11-30989 filed on Feb. 9, 1999 and Hei 11-353982 filed on Dec. 14, 1999 the content of which are incorporated herein by reference.

The invention claimed is:

1. An ink jet printer head comprising:

a head substrate formed by steps of:

cutting a pre-polarized piezoelectric member into a predetermined width to form a piezoelectric body, embedding said piezoelectric body into a recess formed in a base member to form said head substrate, said base member being formed of a material different from a material of said piezoelectric member, forming a plurality of grooves in a piezoelectric body-embedded side of said head substrate, and forming an electrically conductive film on inner walls of said grooves;

a top plate joined to one side of said head substrate; and a nozzle plate joined to an open side of said grooves, said nozzle plate having an ink jet orifice formed for each of said grooves, wherein a width of said recess at a groove-free portion of said grooved head substrate is set smaller than a width of said recess at a groove-formed position.

2. An ink jet printer head comprising:

a head substrate formed by steps of:

cutting two piezoelectric members into a predetermined width to form a piezoelectric body, said two piezoelectric members having been joined together so that a pole of a first piezoelectric member of said two piezoelectric members is opposed to a pole of a second piezoelectric member of said two piezoelectric members, embedding said piezoelectric body into a recess formed in a base member to form said head substrate, said base member being formed of a material different from a material of said first and second piezoelectric members, forming a plurality of grooves in a piezoelectric body-embedded side of said head substrate to form a grooved head substrate, and forming an electrically conductive film on inner walls of said grooves including said first and second piezoelectric members;

a top plate joined to one side of said head substrate; and a nozzle plate joined to an open side of said grooves, said nozzle plate having an ink jet orifice formed for each of said grooves, wherein a width of said recess at a groove-free portion of said grooved head substrate is set smaller than a width of said recess at a groove-formed position.

* * * * *